United States Patent [19]

Parker

[11] 4,419,777

[45] Dec. 13, 1983

[54] BABY BED ROCKING MECHANISM

[75] Inventor: Paraque Parker, Pontiac, Mich.

[73] Assignee: Harold P. Parker, Pontiac, Mich.

[21] Appl. No.: 260,277

[22] Filed: May 4, 1981

[51] Int. Cl.[3] ..... A97D 9/02

[52] U.S. Cl. ..... 5/108; 5/109

[58] Field of Search ..... 5/108, 109

[56] References Cited

U.S. PATENT DOCUMENTS

| | | | |
|---|---|---|---|
| 2,805,427 | 9/1957 | Edgmon | 5/109 |
| 2,890,225 | 2/1959 | Tonkin | 5/109 |
| 3,056,145 | 10/1962 | McKinley | 5/109 |
| 3,186,008 | 6/1965 | Fuller | 5/109 |
| 3,806,966 | 4/1974 | Thompson | 5/109 |
| 3,886,608 | 6/1975 | Casella | 5/108 |

*Primary Examiner*—Alexander Grosz
*Assistant Examiner*—Michael F. Trettel
*Attorney, Agent, or Firm*—Hauke and Patalidis

[57] ABSTRACT

A baby bed rocking mechanism comprising a pair of transverse members each supporting respectively the front legs and the rear legs of a baby bed or crib. The transverse members are pivoted, substantially at their center, relative to a base member. One of the transverse members is mechanically pivoted, or rocked, by a motor driven cam.

6 Claims, 9 Drawing Figures

BABY BED ROCKING MECHANISM

BACKGROUND OF THE INVENTION

The invention relates to beds and more particularly to a rocking mechanism for baby beds or cribs.

In the past, many types of baby bed or crib have been provided with rockers supporting the bed or crib, instead of legs, for providing a convenient means for a person to rock the bed or crib to sooth and putting to sleep a baby or infant laying in the bed or crib.

Diverse power rocking mechanisms have also been developed in the past, as disclosed for example in applicant's prior U.S. Pat. No. 3,357,859, issued Apr. 23, 1968 for Baby Bed and Mechanism for Rocking Same, and in U.S. Pat. No. 3,541,618, issued Nov. 24, 1970 to Sarah J. Johnson et al for Automatic Crib Rocker.

Such devices are generally complex as consisting of many interconnected levers, rotating disks with eccentric drive pins and arms linked to a frame on which a conventional bed or crib is installed, and they often require high power electric motors for starting the bed or crib in rocking motion and sustaining the rocking motion.

The present invention is a simple structure for a baby bed or crib rocking mechanism which does not require complicated lever mechanisms or drive mechanisms, and which is adapted to provide an automatically rocking support for a conventional baby bed or crib.

SUMMARY OF THE INVENTION

The principal object of the invention is to provide a baby bed or crib power rocking mechanism utilizing a single rocking transverse member supporting the front leg of a bed or crib and a similar simple rocking member supporting the rear leg of a bed or crib. The rocking transverse support members are pivoted substantially at their center, and one of the rocking members is oscillated by means of a cam mounted on the output shaft of an electric motor engaged in a cam follower cage mounted on the transverse rocking member.

The many objects and advantages of the present invention will become apparent to those skilled in the art when the following description of the best mode contemplated for practicing the invention is read in conjunction with the accompanying drawings wherein like numerals refer to like parts and in which:

DETAILED DESCRIPTION OF THE PREFERRED EMBODIMENT

Figure 1:
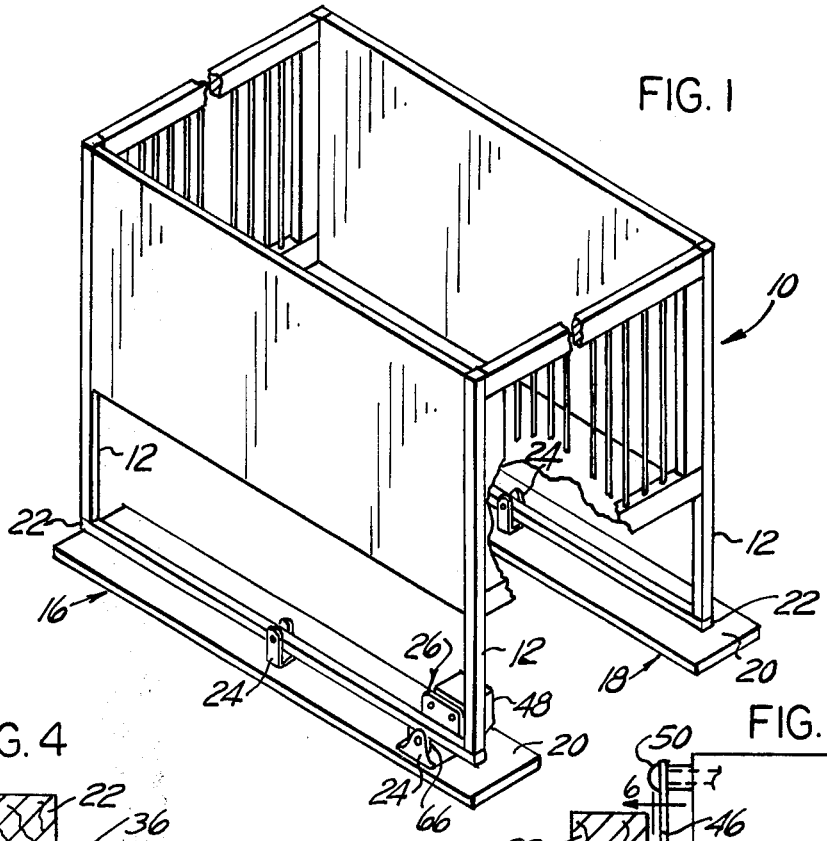
FIG. 1 is a perspective schematic view of a baby bed or crib showing the automatic rocking mechanism of the invention.

Referring to the drawings and more particularly to FIG. 1, there is illustrated a baby bed or crib 10 provided with two pairs of legs 12. One of the pairs of legs is supported by a transversely disposed rocking cradle 16, while the other pair of legs is supported by a similarly disposed cradle 18. Each cradle 16 or 18 consists of a baseboard 20 pivotably supporting a cross-member 22 by way of a U-shaped pivot support member or bracket 34. Each cross-member 22, in turn, supports at each end, one of the bed or crib legs 12. The only difference between the cradle 16 and the cradle 18 is that the cross-member 22 of the cradle 18 is free to rock relative to the baseboard 20 about its pivot support member 24, while the cradle 16 is provided with a power drive means, designated generally at 26, which causes the cross-member 22 of the cradle 16 to be constrained to rock.

Figure 2:
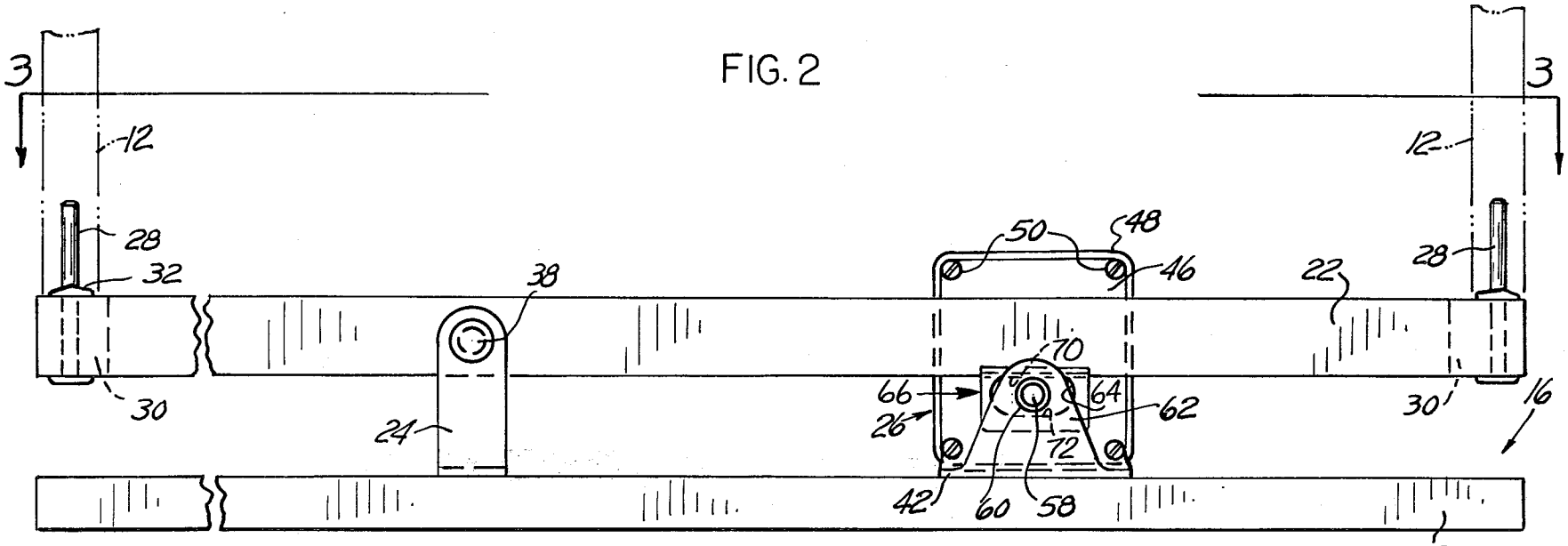
FIG. 2 is an end view of the rocking mechanism of FIG. 1.
Figure 3:
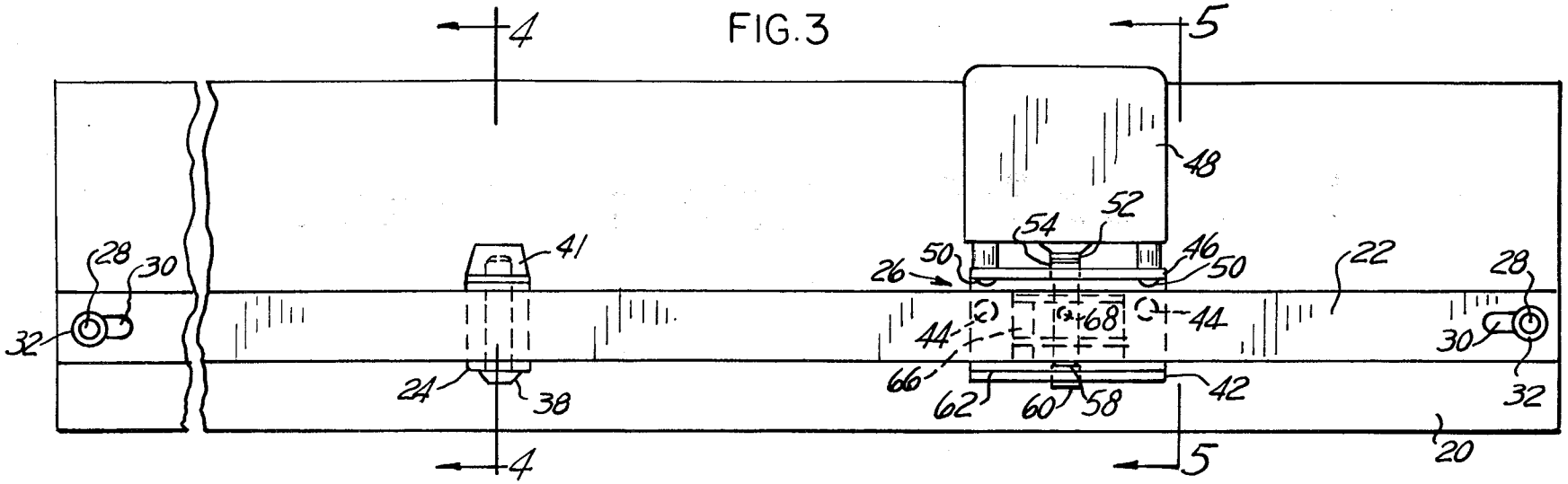
FIG. 3 is a top plan view thereof from line 3—3 of FIG. 2.

As illustrated in detail at FIGS. 2–3, the rocking cross-member 22, which may be made of any convenient material such as metal or preferably wood in the form of a substantially square or rectangular beam, is provided at each end with an upwardly projecting pin 28 passed through a slotted aperture 30, permitting lateral adjustment of the position of the pin 28. The pin 28 is held by any convenient means such as, for example, a push nut 32. The cross-member 22 supports one of the pairs of legs 12 disposed at the head or at the foot of the crib or bed 10 by way of each pin 28 projecting through the bore at the bottom of each leg 12 in which casters are normally installed. The casters are removed and the crib or bed 10, FIG. 1, is placed over the cradles 16 and 18 on the top of the cross-members 22, with the pins 28 projecting in the casters mounting bores in the bottom of the legs 12.

Figure 4:
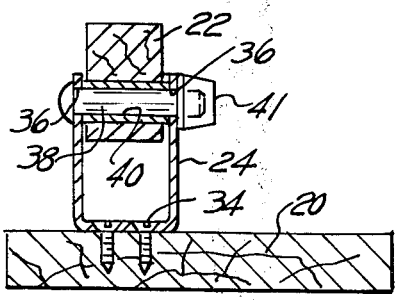
FIG. 4 is a section thereof through line 4—4 of FIG. 3.

The cross-member 22 is supported from the baseboard 20 by the U-shaped pivot support member or bracket 24, FIGS. 2–4, affixed to the top surface of the baseboard 20 by any convenient means such as wood screws 34. The U-shaped pivot support member 24 is provided at the top of its sidewalls with a pair of aligned apertures 36 through which is passed a pin 38, a transverse bore in the cross-member 22 preferably provided with a bearing in the form of a nylon bushing, for example, affording passage therethrough for the body of the pin 38. The pin 38 is held in position through the bracket aligned apertures 38 and the bore 40 in the cross-member 22 by, for example and as illustrated, a push nut 44. The cross-member 22 is therefore able to pivot, relative to the baseboard 20 along a pivot axis coinciding with the center line of the pivot pin 38, which is substantially located at a midpoint between the ends of the cross-member 22.

Figure 5:
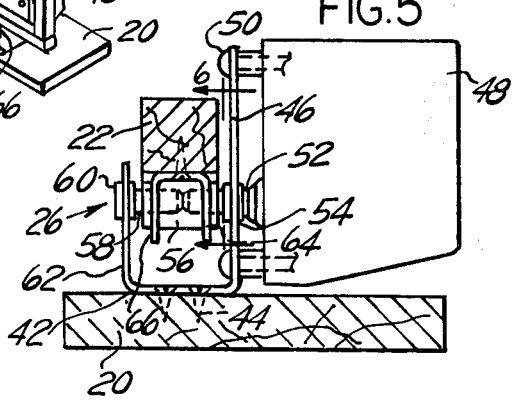
FIG. 5 is a section thereof through line 5—5 of FIG. 3.
Figure 6:
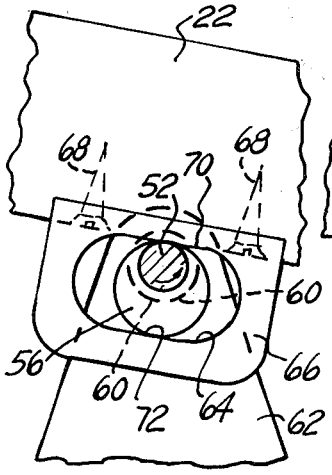
FIG. 6 is a view from line 6—6 of FIG. 5.
Figure 7:
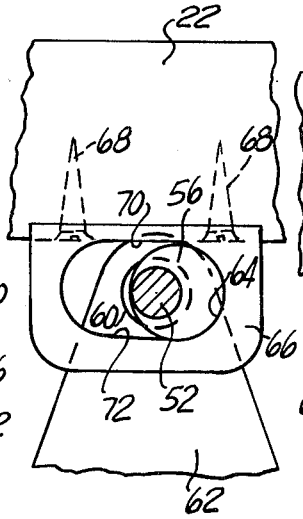
FIGS. 7–9 are views similar to FIG. 6, but showing the rocking mechanism at different positions during one full revolution of the drive motor output shaft.
Figure 8:
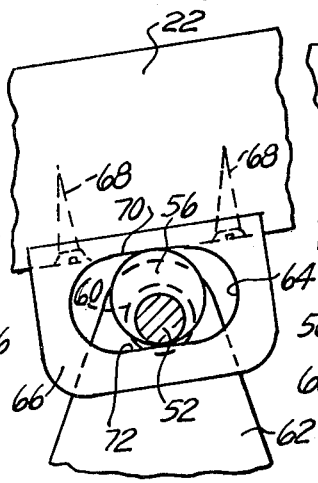
Figure 9:
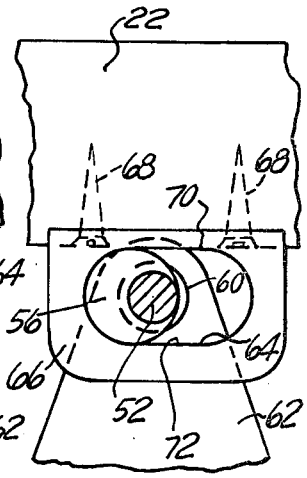

The cross-member oscillation power drive 26 comprises a U-shaped bracket 42, FIGS. 2–3 and 5 mounted on the top surface of the baseboard 20, also preferably made of wood, by any convenient means such as a pair of wood screws 44, such that a sidewall 46 of the U-shaped bracket 42 extends on one side of the cross-member 22. The bracket sidewall 46 support an electric motor 48 mounted on the sidewall 46 by means of mounting screws or bolts 50, the electric motor 48 having an output shaft 52 journalled in a bearing 54 fitted in the bracket sidewall 46. An eccentric member 56, FIGS. 5–9, having a circularly cylindrical peripheral surface, is fastened on the end of the motor drive shaft 52 at one end, and at its other end the eccentric member 56 carries a stub shaft 58, whose axis of rotation is aligned with the axis of rotation of the motor output shaft 52. The stub shaft 58 is journalled in a bearing 60 installed in an appropriate aligned aperture in the other sidewall 62 of the U-shaped bracket 42. The eccentric member 56 is disposed through aligned slots 64, FIGS. 5–9, of a cam follower cage 66 taking the form of a U-shaped member, mounted on the bottom surface of the cross-member 22 by means such as wood screws 68. The slots 64 have parallel sides 70 and 72 spaced apart a distance substantially equal to the diameter of the eccentric member 56, the slot parallel sides 70 and 72 being in turn substantially parallel to the longitudinal axis of the cross-member 22. Therefore, when the motor drive shaft 52 is driven in rotation, the eccentric member 56 is caused to orbit, as illustrated at FIGS. 6–9, in the cam follower slots 64, with its peripheral surface engaged with the slot parallel sides 70 and 72, with the result that the cross-member 22 is oscillated around its pivot axis corresponding to the longitudinal axis of the pivot pin 38, in turn causing the bed or crib supported by the powered cradle member 16 and the non-powered cradle member 18 to rock laterally at a frequency determined by the speed of revolution of the output shaft 52 of the electric motor 48.

The electric motor 48 is connected to a source of electric power, not shown, through an appropriate line, not shown, a switch, not shown, being provided in the line for controllably starting and stopping the operation of the electric motor. If so desired, the line may be connected to the source of electric power through an appropriate timer such that after the rocking of the baby bed or crib is manually started, by closing a switch, rocking may continue until electrical current is turned off by the timer mechanism.

The electric motor 48 may be any convenient low power electric motor readily available in the market, and preferably a geared-down motor providing at its output shaft about 30 to 40 revolutions per minute.

The baseboards 20 may be provided with appropriate caster sockets, one at each end, for installing the casters removed from the bed legs.

Having thus described the present invention by way of a typical example of structural embodiment thereof, modifications whereof will be apparent to those skilled in the art, what is claimed as new is as follows:

1. A mechanism for rocking a bed and the like, said mechanism comprising a pair of transverse rocker members secured to the legs of the bed, a base member supporting each of said transverse rocker members, pivot means between each of said transverse rocker members and each of said base members for pivotably supporting said transverse rocker members relative to said base members and power drive means for positively oscillating one of said transverse rocker members relative to a corresponding base member, said power drive means comprising a prime mover fastened to said base member by a first bracket, said prime mover having a rotatable output shaft passed through a journal bearing in a sidewall of said first bracket, said power drive means further comprising an eccentric member mounted on said output shaft of said prime mover, a stub shaft having an axis of rotation in alignment with the axis of rotation of said output shaft mounted on said eccentric member, said stub shaft being passed through a journal bearing in another sidewall of said first bracket, and a cam follower in the form of a second bracket mounted below said transverse rocker member, said second bracket having an elongated slot in at least one sidewall thereof, each of said elongated slots being provided with substantially parallel sides disposed substantially parallel to the longitudinal axis of said one of said rocker members and said parallel sides of each of said slots being further disposed at a distance from each other corresponding to the width of the eccentric member wherein said eccentric member is disposed between said parallel sides of each of said elongated slots of said second bracket and between said sidewalls of said first bracket.

2. The rocking mechanism of claim 1 wherein said pivot means support said transverse rocker member substantially at mid distance from the ends of said rocker member.

3. The rocking mechanism of claim 2 wherein said power drive means is coupled to said transverse rocker member at an intermediary point between said pivot means and an end of said transverse rocker member.

4. A mechanism for rocking a bed and the like, said mechanism comprising a pair of transverse rocker members secured to the legs of the bed, a base member supporting each of said transverse rocker members, pivot means between each of said transverse rocker members and each of said base members for pivotally supporting said transverse rocker members relative to said base members, and power drive means for positively oscillating one of said transverse rocker members relative to a corresponding base member, said power drive means comprising a prime mover fastened on said base member, said prime mover having a rotatable output shaft, an eccentric member mounted on said output shaft, and a cam follower mounted on said transverse rocker member, said cam follower having an elongated slot having substantially parallel sides disposed substantially parallel to the longitudinal axis of said rocker member, said eccentric member being disposed between said parallel sides of said slot, said eccentric member having a circularly cylindrical peripheral surface and said eccentric member being mounted off center on said prime mover output shaft, said power drive further comprising a stub shaft mounted on the other end of said eccentric cylindrical member, said stub shaft having its axis of rotation aligned with the axis of rotation of said output shaft, a U-shaped bracket mounted on said base member, said U-shaped bracket having a sidewall provided with a journal bearing for said output shaft and another sidewall substantially parallel to said first sidewall provided with a journal bearing for said stub shaft, said eccentric member being disposed between said sidewalls, wherein said cam follower is in the form of a second U-shaped bracket mounted below said rocker member, said second U-shaped bracket having at least one sidewall provided with said elongated slot having said parallel sides disposed substantially parallel to the longitudinal axis of said rocker member, said parallel sides being disposed at a distance corresponding substantially to the diameter of said eccentric member.

5. The rocking mechanism of claim 4 wherein said pivot means support said transverse rocker member substantially at mid distance from the ends of said rocker member.

6. The rocking mechanism of claim 5 wherein said power drive means is coupled to said transverse rocker member at an intermediary point between said pivot means and an end of said transverse rocker member.

* * * * *

UNITED STATES PATENT AND TRADEMARK OFFICE

CERTIFICATE OF CORRECTION

PATENT NO. : 4,419,777

DATED : December 13, 1983

INVENTOR(S) : Paraque Parker

It is certified that error appears in the above–identified patent and that said Letters Patent are hereby corrected as shown below:

Col. 2, line 12, change "34" to --24--.

Signed and Sealed this

*Seventeenth* Day of *April 1984*

[SEAL]

*Attest:*

GERALD J. MOSSINGHOFF

*Attesting Officer*

*Commissioner of Patents and Trademarks*